United States Patent [19]

Stedman

[11] 4,082,197

[45] Apr. 4, 1978

[54] ARTICULATED HIGH LIFT VEHICLE

[75] Inventor: Robert N. Stedman, Chillicothe, Ill.

[73] Assignee: Caterpillar Tractor Co., Peoria, Ill.

[21] Appl. No.: 731,604

[22] Filed: Oct. 12, 1976

[51] Int. Cl.[2] ..... E02F 3/72

[52] U.S. Cl. ..... 214/132; 214/141; 280/764; 212/145

[58] Field of Search ..... 214/132, 141, 152; 212/145; 280/764; 180/8 C, 134, 139

[56] References Cited

U.S. PATENT DOCUMENTS

| | | | |
|---|---|---|---|
| 2,906,501 | 9/1959 | Brell | 214/132 X |
| 2,929,517 | 3/1960 | Phillips | 212/145 |
| 3,007,590 | 11/1961 | Mathew et al. | 214/132 X |
| 3,212,659 | 10/1965 | Koch | 214/132 |
| 3,777,898 | 12/1973 | Gallay | 212/145 X |
| 3,836,025 | 9/1974 | Olson et al. | 214/141 X |
| 3,937,339 | 2/1976 | Geis et al. | 214/141 X |

FOREIGN PATENT DOCUMENTS

| | | | |
|---|---|---|---|
| 2,014,517 | 10/1970 | Germany | 280/764 |

*Primary Examiner*—L. J. Paperner
*Attorney, Agent, or Firm*—Phillips, Moore, Weissenberger, Lempio & Majestic

[57] ABSTRACT

An articulated wheel vehicle comprises first and second frame assemblies pivotally connected together and a pair of steering cylinders pivotally connected between the frame assemblies for pivoting them relative to each other. A telescopic boom is pivotally mounted on the first frame assembly and has a work implement, such as a fork, attached to the end thereof. In a first embodiment of this invention, a pair of lift cylinders are pivotally connected to opposite sides of the second frame assembly and have a ground engaging plate secured therebetween and disposed in underlying relationship relative to the vehicle. In a second such embodiment, an individual plate is secured to a lower end of each lift cylinder and is disposed on a respective side of the vehicle. In carrying forth the operation of this invention, the lift cylinders are extended to engage the plate or plates with the ground to lift the first frame assembly relative to the second frame assembly while simultaneously maintaining the second frame assembly in contact with the ground. Upon alternate extension and retraction of the steering cylinders, the first frame assembly will pivot relative to the second frame assembly to thus place the work implement into an infinite number of work positions about the vehicle.

12 Claims, 6 Drawing Figures

Fig. 5.
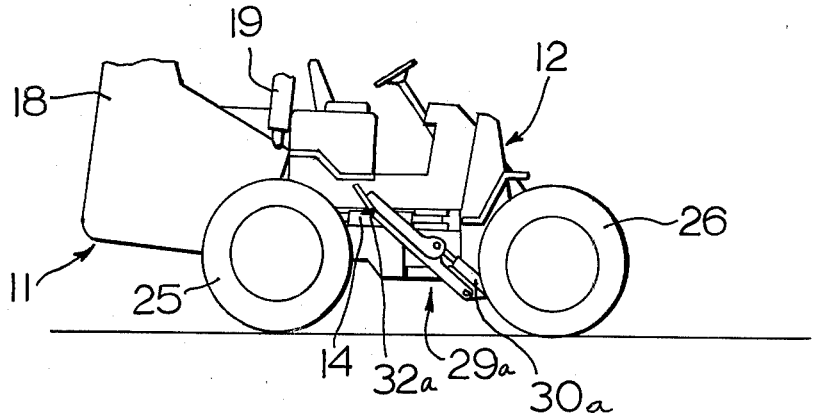
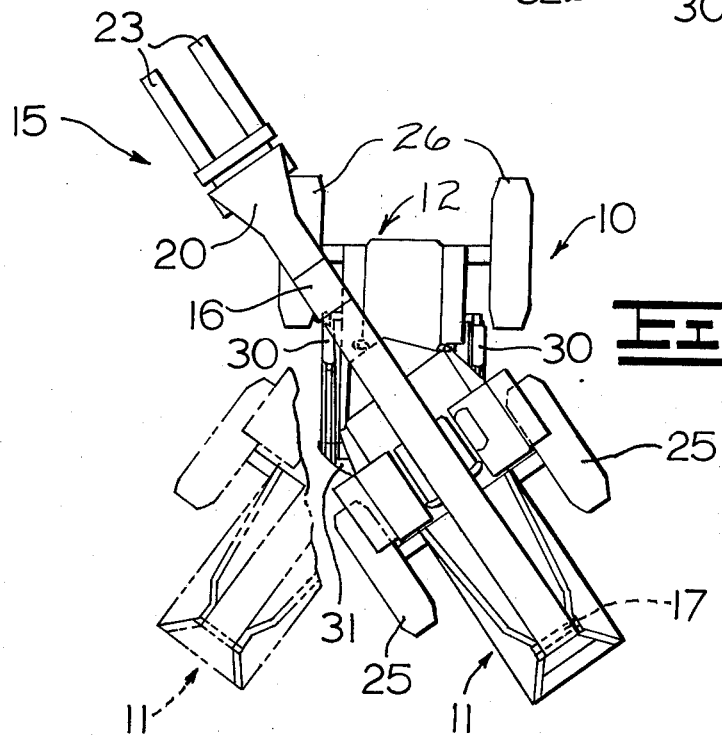
Fig. 2.
Fig. 6.
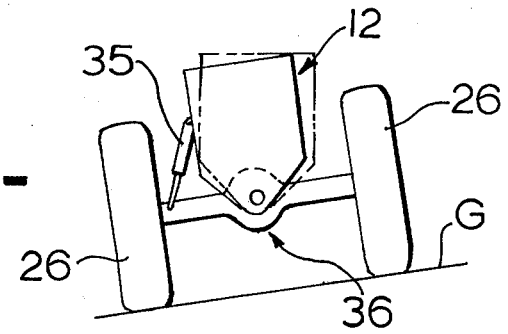

ARTICULATED HIGH LIFT VEHICLE

BACKGROUND OF THE INVENTION

This invention relates to an articulated high lift vehicle of the type having a work implement movably mounted thereon. Conventional high lift vehicles generally comprise a boom pivotally mounted on a frame thereof and a work implement attached to the end of the boom to be positioned adjacent to the vehicle to effect various job tasks. In many such applications, the boom is telescopic and the work implement may comprise a fork, a bucket or other types of standard work tools.

One problem encountered with such conventional vehicles is that of providing slewing capabilities without resorting to costly and complex revolving units on the vehicle. Otherwise stated, it is desirable to provide vehicles of this type with lift, tilt, reach and slew capabilities while yet employing many standard and relatively low cost components normally employed on conventional tractors, for example.

SUMMARY OF THIS INVENTION

An object of this invention is to provide an improved high lift vehicle which in addition to standard lift, tilt and reach capabilities, provides novel slewing capabilities. The vehicle further provides enhanced mobility and stability characteristics and is adapted to include a substantial number of standard components thereon to thus reduce the overall manufacturing cost thereof.

The vehicle comprises first and second frame assemblies pivotally connected together and actuating means, preferably extensible and retractable steering cylinders, interconnected between the frame assemblies to selectively pivot them relative to each other. A work implement means is mounted on the first frame assembly and a lifting means is movably mounted on the second frame assembly to selectively engage ground level to lift the first and second frame assemblies and to further lift the first frame assembly relative to the second frame assembly. Thus, the first frame assembly can be pivoted by the actuating means, relative to the second frame assembly, to selectively place the work implement means in an infinite number of work positions about the vehicle.

BRIEF DESCRIPTION OF THE DRAWINGS

Other objects of this invention will become apparent from the following description and accompanying drawings wherein:

FIG. 2 is a top plan view of the vehicle, but illustrating slewing of the work implement means thereon;

FIG. 5 is a side elevational view of the FIG. 4 vehicle, but illustrating the lifting means in a raised and stored position thereon; and FIG. 6 is a partial rear elevational view of the FIGS. 1–3 vehicle, but further illustrating a leveling cylinder and oscillating axle employed thereon.

DETAILED DESCRIPTION

Figure 1:
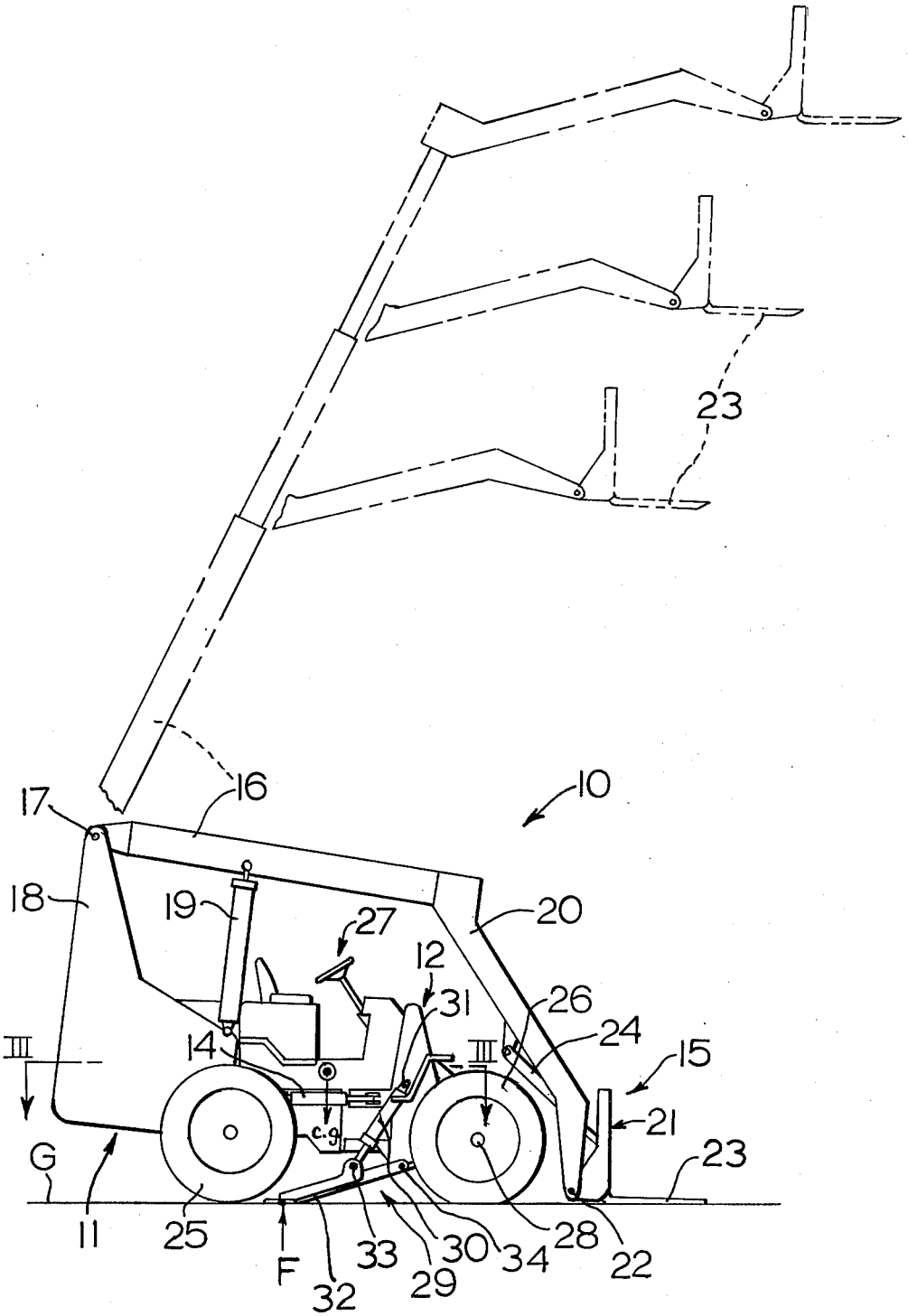
FIG. 1 is a side elevational view of an articulated high lift vehicle embodying this invention and further illustrating work implement means mounted thereon and raised to three different work positions, as illustrated by phantom lines.
Figure 3:
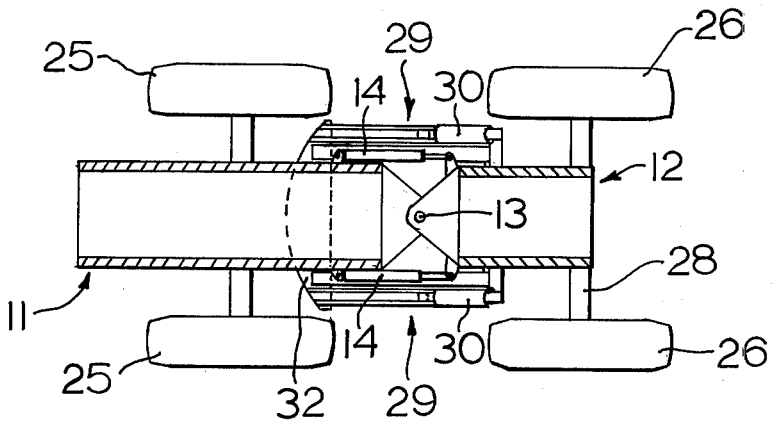
FIG. 3 is a top plan view of the chassis of the vehicle, taken in the direction of arrows III—III in FIG. 1.

FIG. 1 illustrates an articulated high lift vehicle 10 comprising a first frame assembly 11 pivotally connected to a second frame assembly 12 by pivot means comprising a pair of vertically disposed pins 13 (one shown in FIG. 3). Actuating means, preferably in the form of a pair of double-acting hydraulic cylinders 14, are pivotally interconnected in a conventional manner between the first and second frame assemblies to selectively pivot them relative to each other for steering purposes. A work implement means 15 is mounted on first frame assembly 11 for pivotal movements between its solid-line ground engaging position and its phantom-line raised positions, illustrated in FIG. 1.

The work implement means comprises a hydraulically actuated telescopic boom 16 having a first end thereof pivotally mounted by a pin 17 to an upstanding bracket 18, forming an integral part of first frame assembly 11. A couble-acting hydraulic cylinder 19 is pivotally interconnected between the first frame assembly and the boom to selectively raise or lower the same. The boom has a support member 20 secured on a forward end thereof which extends downwardly and forwardly of the vehicle when the boom is disposed in its generally horizontally disposed position illustrated in FIG. 1.

The work implement means further comprises a work tool 21 pivotally mounted on a lower or second end thereof by one or more pins 22. In the embodiment illustrated, the work tool comprises a standard fork 23 and actuating means in the form of a double-acting hydraulic cylinder 24 is pivotally interconnected between the support bracket for the fork and support member 20 to selectively pivot the fork. It should be understood that other types of work implements or tools, such as a lifting hook, bucket, blade or work platform, could be substituted in lieu of fork 23 to further increase the overall versatility of the vehicle.

Frame assembly 11 is mounted on a pair of laterally spaced roadwheels 25 whereas frame assembly 12 is likewise mounted on a pair of roadwheels 26. The articulated steering afforded by steering cylinders 14 and pins 13 will provide quick and efficient maneuvering of the vehicle. Center-point articulation of the frame assemblies will provide that the front and rear roadwheels will always track, i.e., substantially follow the same footprints, to thus reduce tire wear and rolling resistance.

Steering of the vehicle and other operations thereof are under control of the operator, situated in an operator's station 27 mounted on frame assembly 11. Although the vehicle is preferably steered by means of steering cylinders 14, it should be understood that other types of conventional steering mechanisms could be operatively connected to front roadwheels 26 for steering purposes. It should be further noted that each of the front roadwheels is rotatably mounted on a stub-axle, generally illustrated at 28.

Referring to FIGS. 1 and 3, a lifting means 29 is movably mounted on second frame assembly 12 to selectively engage ground level to lift the first and second frame assemblies and to further lift the first frame assembly relative to the second frame assembly. Such lifting of the first frame assembly will thus facilitate pivoting thereof relative to the second frame assembly by means of actuating means or cylinders 14 to thus slew work implement means 15 through an infinite number of work positions about the vehicle, as illustrated in FIG. 2. In particular, the lifting means comprises a pair of double-acting hydraulic cylinders 30 disposed on either side of the vehicle and each pivotally connected to frame assembly 12 by a pin 31. The rod end of each cylinder is pivotally connected to a ground-engaging means or pressure plate 32 by a pin 33 and the pressure plate is disposed beneath the vehicle and pivotally mounted on frame assembly 12 by a pin 34.

FIG. 1 illustrates cylinders 30 (one shown) in their extended positions for forcing plate 32 against ground G to raise rear roadwheels 25. It should be noted that front roadwheels 26 will remain static and that frame assembly 12 will pivot clockwise about axles 28 of the roadwheels. Selective extension and retract 11 and work implement means 15 to be pivoted about pins 13 to slew and position fork 23 to various work positions, as illustrated in FIG. 2. It should be noted that the center of gravity (c.g.) of the vehicle is always located forwardly of the area of engagement of plate 32 with the ground which creates a reaction force F thereat, i.e., the center of gravity is disposed between roadwheels 26 and plate 32. Such disposition of the center of gravity will prevent tipping of the vehicle upon all phases of movement of work implement means 15. As suggested above, although steering cylinders 14 preferably provide the dual function of steering the vehicle and providing slewing capabilities of work implement means 15, a separate steering mechanism could be provided for front roadwheels 26.

Figure 4:
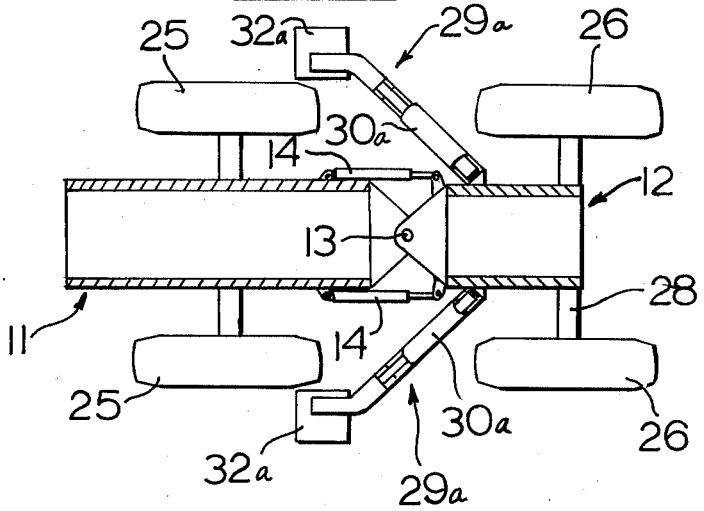
FIG. 4 is a view similar to FIG. 3, but illustrating a modification of lifting means employed on the vehicle.

FIGS. 4 and 5 illustrate a modification of the articulated high lift vehicle of this invention wherein corresponding constructions are depicted by identical numerals, but with modified constructions being accompanied by an "*a*". The modification essentially differs from that illustrated in FIGS. 1–3 in that lifting means 29 has been replaced by a pair of separate lifting means **29*a*, disposed on either side of the vehicle. Each lifting means 29*a* comprises a double-acting hydraulic cylinder 30*a* pivotally interconnected between frame assembly 12 and a ground engaging means or pressure plate or foot pad 32*a***.

Upon extension of cylinders **30*a* (FIG. 4), the footpads will engage the ground to raise frame assembly 11 relative to frame assembly 12 in the same manner as explained above. FIG. 5 illustrates the cylinders in their retracted conditions of operation whereby footpads 32*a* are raised to stored positions alongside the vehicle. If so desired, suitable means (not shown) may be connected between frame assembly 12 and each lift means 29*a*** to pivot the lift means inwardly towards the vehicle to the stored position thereon.

FIG. 6 illustrates a further modification of the FIGS. 1–3 vehicle. In particular, a double-acting hydraulic cylinder 35 is pivotally interconnected between front frame 12 and one end of a standard oscillating axle assembly 36. Thus, the operator can selectively extend or retract the cylinder or leveling means to compensate for side hill slopes and the like by pivoting the axle assembly on frame 12.

What is claimed is:

1. A mobile vehicle comprising:

a first frame assembly mounted on a pair of laterally spaced road wheels, a second frame assembly mounted on a pair of laterally spaced road wheels and pivotally connected to said first frame assembly, actuating means interconnected between said first and second frame assemblies for selectively pivoting them relative to each other, work implement means comprising a boom having a first end thereof pivotally mounted on a bracket integrally secured to said first frame assembly and a work tool mounted on a second end of said boom, work tool cylinder means acting between said work implement means and said first frame assembly, and lifting means comprising a pair of double acting lift cylinders pivotally mounted on either side of said second frame assembly for storage therealong when said lift cylinders are maintained in their retracted conditions of operation and ground-engaging means pivotally mounted on said second frame assembly and pivotally attached to said lift cylinders for selectively engaging ground level upon extension of said cylinders to lift said first and second frame assemblies and to lift said first frame assembly relative to said second frame assembly which has its roadwheels maintained in engagement with ground level whereby said first frame assembly can be pivoted relative to said second frame assembly to selectively place said work implement means in an infinite number of work positions about said vehicle, said work tool being movable by action of said work tool cylinder means to a side of said second frame removed from said first frame, the center of gravity of said vehicle being disposed between said ground-engaging means and the roadwheels mounted on said second frame assembly.

2. The vehicle of claim 1 wherein said actuating means comprises at least one double-acting hydraulic cylinder pivotally interconnected between said first and second frame assemblies.

3. The vehicle of claim 1 wherein said actuating means comprises a pair of double-acting hydraulic steering cylinders pivotally interconnected between said first and second frame assemblies for selectively pivoting said second frame assembly relative to said first frame assembly during steering of said vehicle and for pivoting said first frame assembly relative to said second frame assembly when said lift means is actuated to lift said first and second frame assemblies.

4. The vehicle of claim 1 wherein said boom is telescopic.

5. The vehicle of claim 1 wherein said work tool cylinder means further comprises at least one double-acting hydraulic cylinder pivotally interconnected between said first frame assembly and said boom to selectively raise and lower said boom upon selected extension and retraction of said last-mentioned cylinder.

6. The vehicle of claim 1 wherein said boom is generally horizontally disposed when in its lowered position and further comprising a support member secured on an end of said boom and extending downwardly and forwardly of said vehicle, said work tool mounted on said support member.

7. The vehicle of claim 1 wherein said work tool comprises a fork.

8. The vehicle of claim 1 wherein said work tool is pivotally mounted on said boom and further comprising actuating means pivotally interconnected between said boom and said work tool for selectively pivoting said work tool on said boom.

9. The vehicle of claim 1 further comprising an operator's station mounted on said first frame assembly.

10. The vehicle of claim 1 wherein said ground-engaging means comprises a single plate pivotally attached to said second frame assembly for vertical movements thereon and to each of said cylinders and disposed beneath said vehicle.

11. The vehicle of claim 1 wherein said ground-engaging means comprises a separate plate pivotally attached to said second frame assembly for vertical movement thereon and to each of said lift cylinders and disposed on outward side of said vehicle.

12. The vehicle of claim 1 wherein the roadwheels of said second frame assembly are mounted on an oscillating axle assembly and further comprising leveling means connected between said second frame assembly and said axle assembly for selectively pivoting said axle assembly on said second frame assembly.

* * * * *